United States Patent [19]

Mainland et al.

[11] Patent Number: 4,964,232

[45] Date of Patent: Oct. 23, 1990

[54] SINGLE BARREL BREAK-ACTION TRAP SHOTGUN

[75] Inventors: Donald R. Mainland; Keith J. Sprangers, both of Racine, Wis.

[73] Assignee: U. S. Competition Arms, Inc., Racine, Wis.

[21] Appl. No.: 400,725

[22] Filed: Aug. 30, 1989

[51] Int. Cl.[5] ..... F41C 7/11

[52] U.S. Cl. ..... 42/44; 42/45; 42/46; 42/75.02; 42/75.03; 42/75.04

[58] Field of Search ..... 42/44, 45, 46, 47, 75.02, 42/75.03, 75.04, 40, 41

[56] References Cited

U.S. PATENT DOCUMENTS

| | | | |
|---|---|---|---|
| 108,942 | 11/1870 | Scott | 42/75.04 |
| 391,155 | 10/1888 | Johnson et al. | 42/40 |
| 545,355 | 8/1895 | Foster | 42/44 |
| 550,261 | 11/1895 | Ehbets | 42/44 |
| 1,002,798 | 9/1911 | Baker | 42/41 |
| 2,158,148 | 5/1939 | Pugsley | 42/41 |
| 4,063,379 | 12/1977 | Ruger | 42/75.04 |
| 4,282,671 | 8/1981 | Wood et al. | 42/75.01 |

FOREIGN PATENT DOCUMENTS

| | | | |
|---|---|---|---|
| 0603118 | 9/1925 | France | 42/47 |
| 0691807 | 3/1930 | France | 42/47 |
| 710234 | 1/1931 | France | 421/47 |

*Primary Examiner*—Charles T. Jordan

*Assistant Examiner*—Michael Carone

*Attorney, Agent, or Firm*—Nilles & Nilles

[57] ABSTRACT

The trap gun stock has a projection which mates snugly with a complementary-shaped depression in the rear end of the receiver and is secured therein by a spring-loaded stock bolt which extends through the stock and screws into a stud on the receiver. A latch on the fore-end iron engages a barrel lug to releasably secure the barrel to the fore-end iron. An adjustment shoe at the edge of a latch-hole in the fore-end iron engages the barrel lug to ensure precise barrel positioning. A plastic, resilient, low-friction, heat-resistant stabilizing insert fixed to the fore-end wood engages the barrel to facilitate fitting the barrel in non-contacting relationship in a groove in the fore-end wood handgrip. An extractor/ejector mechanism on the barrel and on the fore-end iron operates when the gun is opened to partially extend an unfired shell or to fully eject an empty shell casing. The fire control mechanism is cocked by opening the gun after the action has been unlocked. An action locking bolt slidably mounted on the receiver is movable to lock and unlock positions relative to the barrel by a swingable bolt actuator which, in turn, is swung by a manually rotatable top lever on the receiver. In unlock position the bolt is clear of the barrel locking groove and allows the gun to be opened, but operates an out-of-battery pin to prevent the trigger from being pulled while the gun is open.

19 Claims, 5 Drawing Sheets

SINGLE BARREL BREAK-ACTION TRAP SHOTGUN

BACKGROUND OF THE INVENTION

1. Field of Use

This invention relates to a single barrel break-action trap shotgun and, in particular, to improved means for securing the stock to the receiver, to improved means for securing the barrel to the fore-end iron, to an improved top lever and actuator for the action locking bolt and to an improved out-of-battery pin in the fire control mechanism.

2. Description of the Prior Art

A wide variety of single barrel break-action shotguns for trapshooting, hunting and other sporting purposes are known or are in use. Trap guns typically incorporate rugged structural features and important safety features, as well as various sophisticated features and other refinements which enhance their utility and ease of handling in the very specialized sport of trapshooting.

In some trap guns, the shoulder stock is connected to the receiver in a manner which can result in cracking of the wooden stock in the region where it joins the receiver as a result of leveraged force entailed in repeatedly breaking open and reclosing the breach after each firing of the gun. This is a troublesome and costly repair.

In some trap guns, the top lever is designed and constructed so that it must be swung manually through an unduly large horizontal arc (as much as 30° or more) between lock and unlock positions each time the gun is to be broken open. This is a clumsy and annoying operation for professional shooters. Furthermore, shooters may be right-handed or left-handed, whereas some prior art guns provide a top lever which is adapted for right-handed shooters only because it is impossible or too costly to manufacture a gun wherein the top lever is custom-designed for a left-handed shooter.

In some trap guns, there are insufficient safety mechanisms to prevent the gun from being accidentally fired, if for some reason the breach is re-opened after the gun has been loaded and re-cocked but before the shell is fired. This is dangerous for the shooter and nearby companions on the trapshooting range.

In some trap guns, precisely fitting the barrel to the fore-end iron during manufacture in such a manner as to ensure accuracy during aiming and firing is done on a cut-and-try basis.

In some trap guns, precisely fitting the barrel in a groove in the fore-end wood during manufacture is carried out on a cut-and-try basis which is time-consuming, labor-intensive, occasionally wasteful of expensive materials, and unduly adds to the cost of the gun.

It is desirable, therefore, to provide an improved single barrel break-action trap shotgun which eliminates or overcomes the aforesaid drawbacks and has other advantages.

SUMMARY OF THE INVENTION

A single barrel break-action trap shotgun in accordance with the invention generally comprises a wooden stock, a receiver, a stock bolt for securing the stock to the receiver, a fore-end iron pivotally and detachably connected to the receiver, a fore-end wood or hand grip mounted on the fore-end iron, a barrel having a barrel lug, and a barrel latch by which the barrel is detachably mounted on the fore-end iron.

The stock has a projection which mates snugly with a complimentary-shaped depression in the rear end of the receiver and the stock bolt, which is spring-loaded, extends through a bore in the stock and screws into an internally threaded receiver stud at the rear end of the receiver.

The barrel latch is mounted on the fore-end iron and is releasably engageable with the barrel lug to releasably secure the barrel to the fore-end iron.

An adjustment shoe is fixedly (but adjustably) mounted at the edge of a latch-hole in the fore-end iron and engages the barrel lug to ensure precise barrel positioning during gun manufacture and subsequently to compensate for wear on the lug resulting from latch operations.

A plastic, resilient, low-friction, heat-resistant stabilizing insert is fixedly mounted on the fore-end wood and engages the barrel to facilitate fitting of the barrel in a groove in the fore-end wood in non-contacting relationship during manufacture.

A shotgun shell extractor/ejector mechanism is mounted on the barrel and on the fore-end iron and operates in response to the position of a telltale rod to partially extend an unfired shell when the gun is opened before firing and to fully eject an empty shell casing when the gun is opened after firing.

A fire control mechanism and an action locking mechanism are mounted in the receiver.

The fire control mechanism comprises a housing detachably mounted in the receiver and on which are mounted a trigger, a sear, a hammer, a spring-loaded mainspring plunger connected to cause the hammer to strike a spring-loaded firing pin when the trigger is pulled while the fire control mechanism is cocked, an out-of-battery pin to prevent firing when the breech is unlocked, and a safety. The firing pin is mounted on the receiver through a top lever, as hereinafter described, and the out-of-battery pin is associated with an action locking bolt as hereinafter described.

A cocking mechanism is mounted on the fore-end iron and operates to cock the fire control mechanism when the gun is opened after being fired. Opening the gun causes a cocking insert on the fore-end iron to axially move a cocking rod which, in turn, forces a pivotable cocking link into engagement with the hammer which is then moved to cocked position, along with other components of the fire control mechanism.

The action locking mechanism comprises the aforementioned action locking bolt which is slidably mounted on the receiver and movable forwardly and rearwardly to lock and unlock positions, respectively, by means of a swingable bolt actuator which, in turn, is swung by a manually rotatable top lever mounted on the receiver. In lock position the bolt engages a locking groove in the breech end of the barrel. In unlock position the bolt is clear of the barrel locking groove and allows the gun to be opened, but then operates the out-of-battery pin so as to move it into an interfering position to prevent the trigger from being pulled while the gun in open. The action locking mechanism is designed so that it can be manufactured to suit either a right-handed or a left-handed shooter with only minor modification of certain components.

A trap gun according to the invention embodies numerous advantages over the prior art. For example, the stock is firmly secured to the receiver in such a manner as to virtually eliminate the possibility of the stock from loosening, cracking or breaking as result of opening and closing the gun or sideward physical blows.

When the top lever is rotated through a relatively short arcuate distance of only 20° to unlock position, the bolt moves rearwardly against the out-of-battery pin to move the latter into interfering relationship with the trigger so that the trigger cannot be pulled.

The telltale rod controls the extractor/ejector mechanism and discriminates between fired and unfired shells as regards the manner of their expulsion from the barrel breech.

The adjustment shoe on the rear edge of the fore-end iron latch hole facilitates precise and adjustable positioning of the barrel on the fore-end iron during manufacture and eliminates undue costly and time-consuming cut-and-try fitting methods.

The stabilizing insert at the front end of the fore-end wood eliminates the need to closely fit the barrel in the groove in the fore-end wood during manufacture, yet provides for a solid connection therebetween.

Other objects and advantages of the invention will hereinafter appear.

DRAWINGS

DESCRIPTION OF A PREFERRED EMBODIMENT

STOCK ATTACHMENT MEANS

Figure 1:
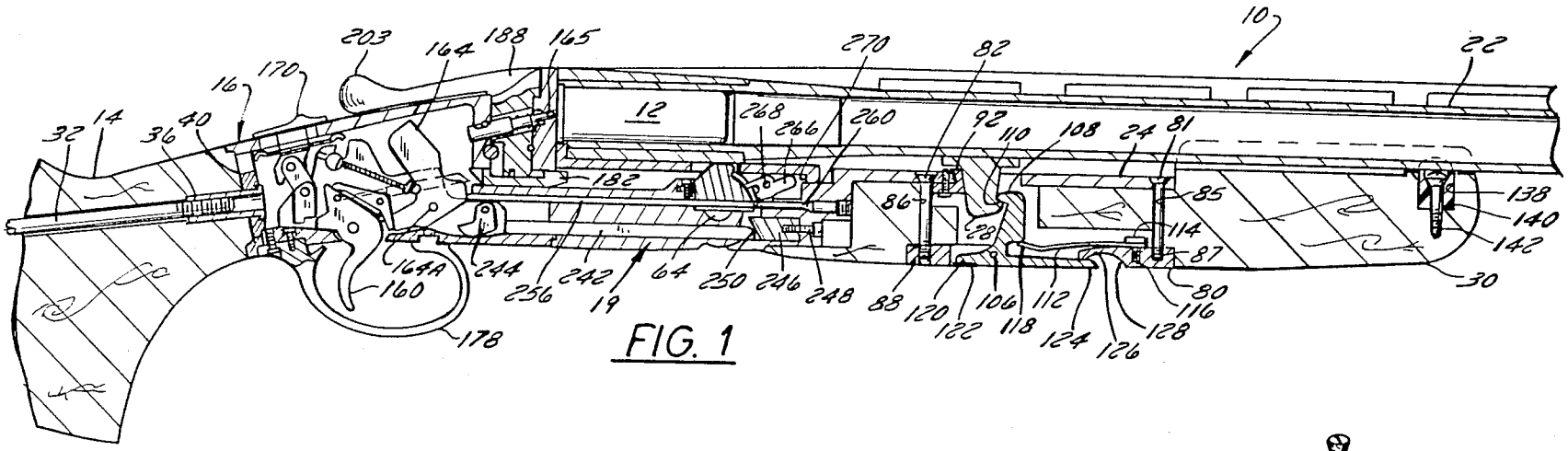
FIG. 1 is a longitudinal cross-sectional view of a trap gun in accordance with the present invention and shows the gun in loaded, breech-closed and cocked condition.
Figures 2, 4, 7, 17:
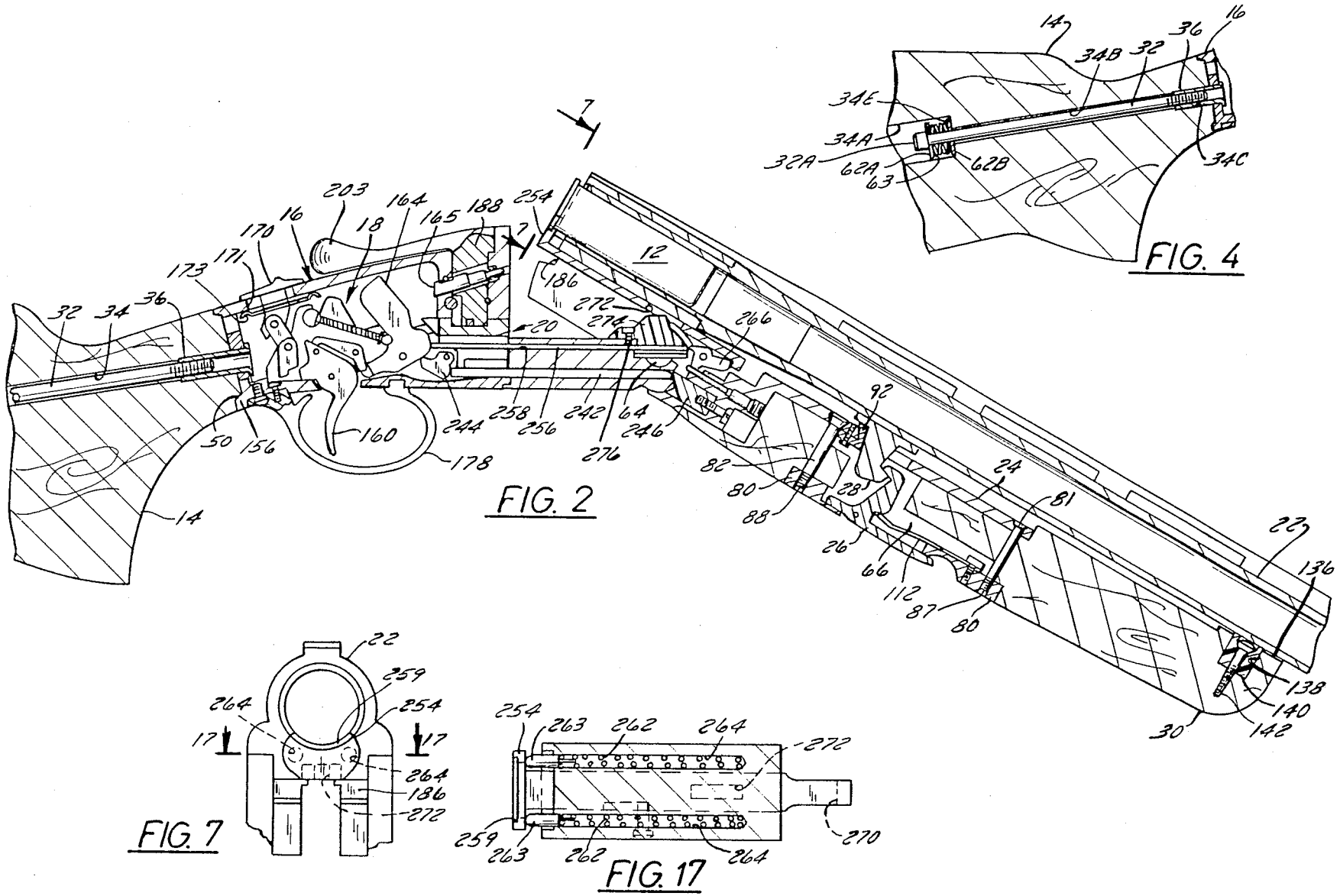
FIG. 2 is a view similar to FIG. 1 and shows the gun in loaded, breech-open and cocked condition.
FIG. 4 is a cross-sectional view of the stock and an elevational view of the stock bolt therein.
FIG. 7 is an elevation view of the breech end of the barrel showing the action lock bolt receiving groove therein.
FIG. 17 is a cross-sectional view of the extractor/ejector taken on line 17—17 of FIG. 7.
Figure 14:
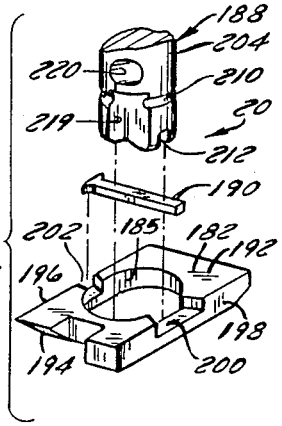
FIG. 14 is a perspective view showing the top lever, the action locking bolt and the bolt actuator.
Figure 11:
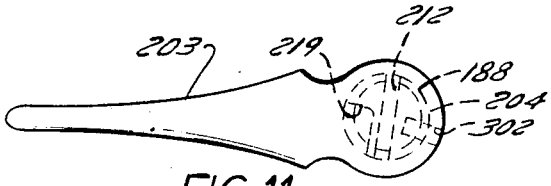
FIG. 11 is a top plan view of the top lever.

Referring to FIGS. 1 and 2, a single barrel break-action trap shotgun 10 in accordance with the present invention comprises a wooden shoulder stock 14, a receiver 16, a fire control mechanism 18, a cocking mechanism 19 and an action locking mechanism 20 (FIG. 14) mounted in the receiver, a barrel 22, a fore-end iron 24 pivotally mounted on the receiver and detachably connected to the barrel by a barrel latch 26 which engages a barrel lug 28 on the barrel, and a fore-end wood handgrip 30 connected to the fore-end iron.

FIG. 1 shows gun 10 closed, loaded with a shotgun shell 12, cocked and ready to fire. FIG. 2 shows gun 10 open, loaded but with a shotgun shell 12 in an extractable partially extended position, cocked and ready to be closed.

Referring to FIGS. 1, 2, 3 and 4, means for detachably connecting stock 14 to the rear end of receiver 16 comprises a stock bolt 32 inserted in a stock bore 34 extending lengthwise through the stock. The threaded end of stock bolt 32 screws into an internally threaded receiver stud 36 which is fixedly mounted as by brazing or welding in a central opening 38 in a plate 40. Plate 40 is fixedly mounted as by brazing or welding in an opening 42 in an end wall 44 at the rear end of receiver 16. The plate 40 and end wall 44 cooperate with an annular rim 46 on receiver 16 to define an annular recess 48 having a flat base surface provided by plate 40 and end wall 44, a tapered circumferential side edge surface 50 and a flat circumferential end surface 52. The hollow cylindrical internally threaded receiver stud 36 extends rearwardly from the flat base surface. The fore-end of stock 14 terminates in a projection 54 which has a front surface 56, a tapered side edge surface 58 and a flat edge surface 60. The projection 54 on stock 14 is complementary in shape to the annular recess 48 on receiver 16 and fits snugly thereinto when stock bolt 32 is tightened. As FIG. 4 shows, the stock bore 34 is internally sized so to define three portions of different diameters, namely: a rear end portion 34A, an intermediate portion 34B and a front end portion 34C. Rear end bore portion 34A is large enough to accommodate the head 32A of stock bolt 32 and a biasing assembly adjacent the underside of the bolt head and comprising a pair of washers 62A and 62B having a helical compression spring 63 therebetween. Intermediate bore portion 34B is large enough to snugly receive the shank of stock bolt 32 and cooperates with the larger diameter rear end portion 34A to define a shoulder 34E against which the biasing assembly bears when stock bolt 32 is tightened. Front end bore portion 34C is large enough to snugly accommodate receiver stud 36.

The foregoing arrangement avoids the use of conventional relatively long and thin wooden projections in the stock at the very location where it is subjected to the greatest mechanical stress either during cocking operations or from accidental physical blows. Stock projection 54 is short and cannot be sheared off. The generally tapered projection 54 fits tightly in receiver recess 48 and the tightness increases as bolt 32 is screwed into stud 36. The large flat surface 56 on stock 14 bears against the large flat base surface on receiver 16 to prevent sideways rocking motion of the stock and the rim 46 cooperates to prevent such rocking.

Latch Adjustment Means

Figure 6:
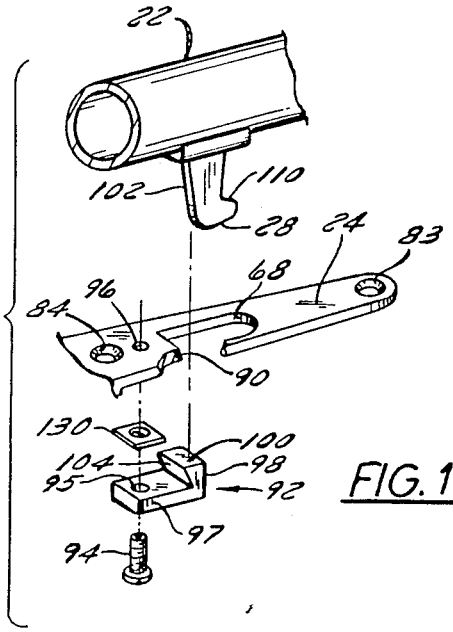
FIG. 6 is an exploded top perspective view of the barrel lug, a portion of the fore-end iron, the adjustable shoe and a shim.

Referring to FIGS. 1, 2 and 6, improved means are provided for securing barrel 22 to fore-end iron 24 so as to eliminate any "play" or undesirable axial displacement therebetween. More specifically, the rear of fore-end iron 24 is pivotally connected to the front end of receiver 16 by a joint pin 64. The fore-end wood 30 has a vertical opening 66 therethrough which registers with a vertical opening 68 in fore-end iron 24 and accommodates barrel lug 28 which is fixedly secured to the underside of barrel 22 by welding. A fore-end lug bar 80 is disposed in the lower end of vertical opening 66 of fore-end wood 30. A pair of fore-end wood mounting screws 81 and 82 extend downwardly through screw holes 83 and 84 in fore-end iron 24 and through registering screw holes 85 and 86 in fore-end wood 30 and are screwed into threaded screws holes 87 and 88 in lug bar 80. The mounting screws 81 and 82 operate to tightly secure lug bar 80 to the underside of fore-end wood 30 and to tightly secure the latter to the underside of fore-end iron 24.

Referring to FIG. 6, the rear edge 90 of vertical opening 68 in fore-end iron 24 slopes downwardly and forwardly and is covered by a fore-end adjustment shoe 92 which is rigidly secured to the fore-end iron by a cap screw 94 which extends through an unthreaded screw hole 95 in the shoe and screws into a threaded screw hole 96 in the fore-end iron adjacent rear edge 90. The shoe 92 comprises a base portion 97 in which the screw hole 95 is provided and an upright portion 98. Upright portion 98 has a sloped front surface 100 which matches the slope of a rear surface 102 of barrel lug 28. Upright portion 98 has a rear surface 104 which matches the slope of rear edge 90 of opening 68 in fore-end iron 24.

Referring to FIGS. 1 and 2, latch 26 is pivotally mounted on lug bar 80 by a latch pin 106. Latch 26 has a latch lip 108 on its upper end which releasably engages a lug lip 110 on the lower end of barrel lug 28. Latch 26 is biased into latched position by a resilient leaf spring 112 which has its forward end rigidly secured to lug bar 80 by a spring-mounting screw 114 which screws into a threaded hole 116 in the lug bar. The rear end of spring 112 engages a shoulder 118 in latch 26 and biases the latch into engagement with barrel lug 28. The latch lip 108 and lug lip 110 slope forwardly and downwardly so that the latch is biased in a counterclockwise direction (with respect to FIG. 1) and this forces barrel 22 downwardly and rearwardly relative to fore-end iron 24 so that the rear surface 102 of barrel lug 28 tightly bears against the sloped front surface 100 of shoe 92 to inhibit forward movement of barrel 22. Counterclockwise rotation of latch 26 is limited by engagement of the rear tang 120 of the latch with a forwardly extending projection 122 on lug bar 80 and by engagement of a latch release lever 124 with a rearwardly extending projection 126 on lug bar 80. Latch 26 can be manually rotated clockwise against spring bias and out of engagement with barrel lug 28 so as to enable detachment of the barrel from the fore-end iron by means of the forwardly extending latch-release lever 124. A recess 128 on the underside of projection 126 on lug bar 80 enables the shooter's finger to reach and move lever 124 so as to move latch 26 to unlatched position.

As explained above, cooperation between barrel lug 28, latch 26 and shoe 92 prevent fore and aft movement of barrel 22 relative to fore-end iron 24. If necessary, a shim 130 (see FIG. 6) can be installed between base portion 97 of shoe 92 and the underside of fore-end iron 24 to adjust the vertical position of upright portion 98 of the shoe relative to barrel lug 28. It is to be noted that front surface 100 and rear surface 104 of upright portion 98 of shoe 92 slope forwardly and downwardly at different angles so that adjustment of the vertical position of the shoe by use of a shim 130 of desired thickness has the effect of adjusting the fore and aft position of the surface 100 of the shoe relative to the rear edge 102 of barrel lug 28. This has the effect of adjusting the fore and aft position and barrel 22 relative to fore-end iron 24. This adjustment can be made during manufacture of the gun or in the field, if necessary. It eliminates the need to carefully cut and shape the rear edge 90 of opening 68 as was the case in prior art fitting of a barrel to a fore-end iron.

Stabilizer Insert

Figure 5:
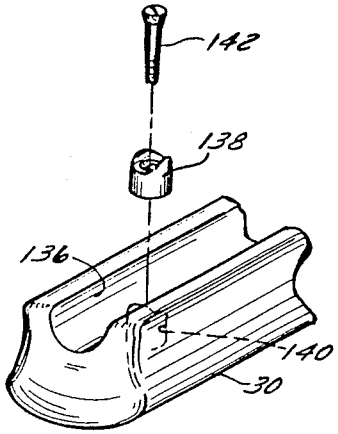
FIG. 5 is an exploded top perspective view of a stabilizing insert and a portion of the front end of the fore-end wood.
Figure 3:
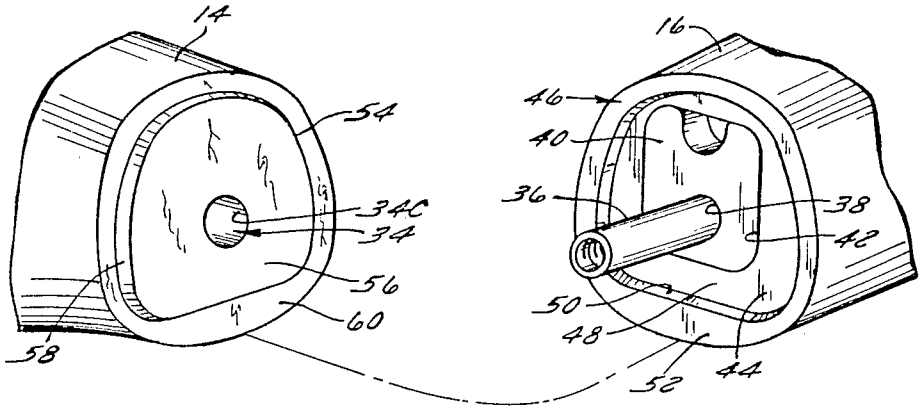
FIG. 3 is a perspective view of the front end of the stock and the rear end of the receiver.

As FIGS. 1 and 5 show, the front end of fore-end wood handgrip 30 is provided with a longitudinal groove 136 for accommodating barrel 22. However, the surface of groove 136 is spaced from and does not make physical contact with barrel 22. Therefore, to further support barrel 22 and to prevent "play" between fore-end wood grip 30 and the barrel when the gun is handled or aimed, the fore-end wood grip is provided with a plastic, resilient, low-friction, heat-resistant stabilizing insert member 138 which is inserted in a vertical hole 140 drilled in the fore-end wood near the front end of groove 136 and is fixedly secured therein by a wood screw 142. The stabilizing member extends upwardly from hole 140 and engages the underside of barrel 22 to provide support and prevent "play". Insert member 138 eliminates the need to precisely shape and fit groove 136 to match barrel 22 during manufacture of the gun, as is the case in some prior art guns.

The insert member is fabricated of plastic material, such as Torlon Poly (amide or imide) which will not scratch the barrel and which can withstand high gun barrel temperature on the order of 450° F. to 500° F. and will not char or burn.

Receiver

Figure 9:
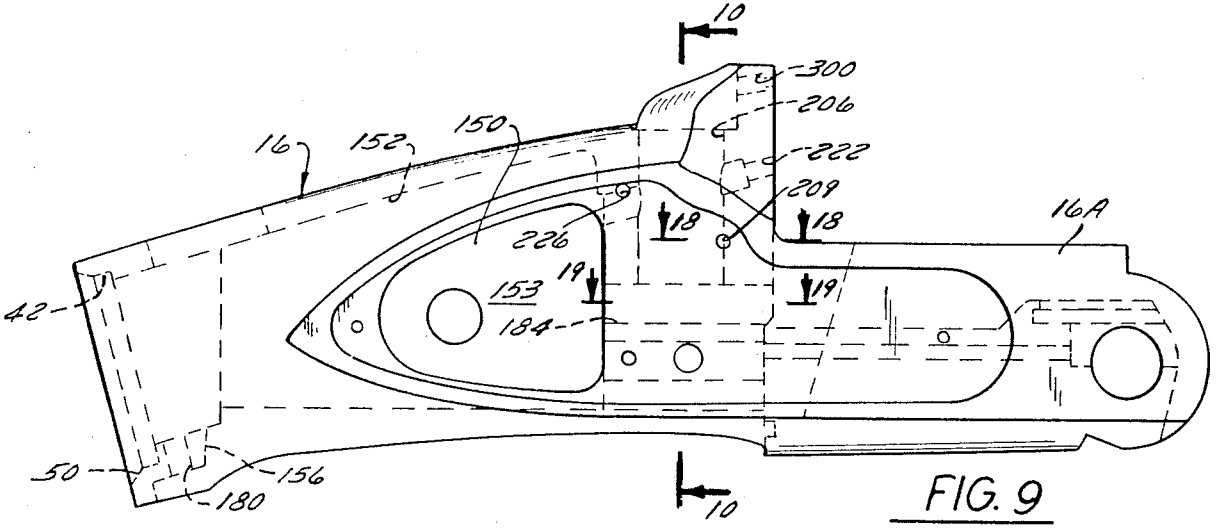
FIG. 9 is a side elevation view of the receiver prior to installation of various components therein.

Referring now to FIGS. 1, 2, 3, 7, 8, 9, 10 and 15 the receiver 16 supports and forms part of fire control mechanism 18, action locking mechanism 20 and a cocking mechanism 19. Referring to FIG. 9, receiver 16 is provided at its rear end with a chamber 150 defined by an upper wall 152, a pair of spaced apart side walls 153 and 154 (FIG. 15) and end wall 44 and plate 40. Chamber 150 has an opening 156 at the bottom through which fire control mechanism 18 is inserted.

Figure 8:
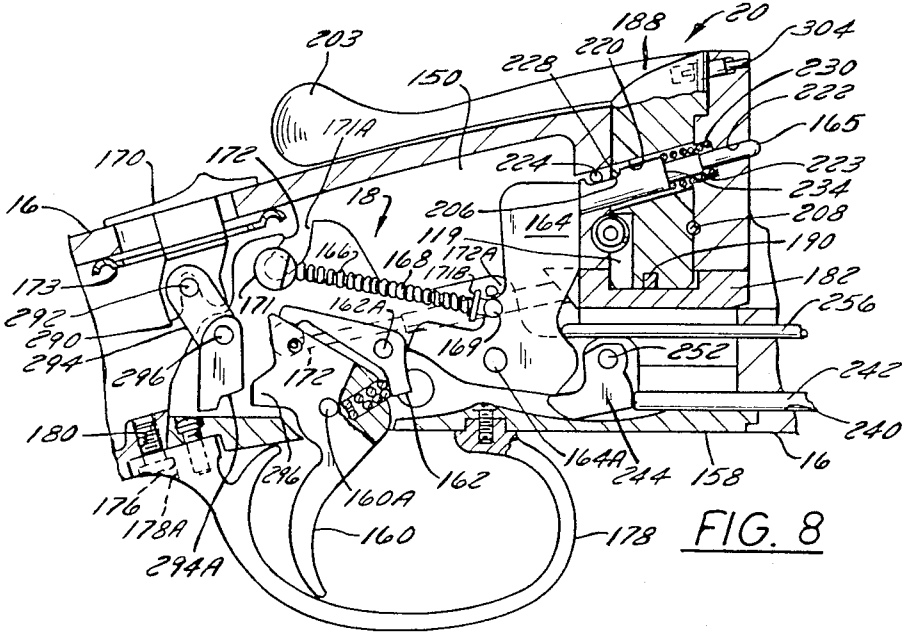
FIG. 8 is a side elevation view, partly in cross-section, of the fire control mechanism and shows it in fired condition.

Referring to FIG. 8, fire control mechanism 18, shown uncocked and hereinafter described in detail, broadly comprises a fire control housing 158 on which are mounted or supported a trigger 160, a sear 162, a hammer 164, a mainspring 166, a mainspring plunger 168, a safety pawl 170, an out-of-battery pin 172 and a trigger guard 178. The housing 158 is secured in the opening 156 at the bottom of chamber 150 by two retaining fasteners or screws 176 (only one shown) which extend through unthreaded screw holes 178A in trigger guard 178 and housing 158 and screw into threaded screw holes 180 on the rear underside of receiver 16.

Action Locking Mechanism

Referring to FIGS. 7 through 16, action locking mechanism 20 generally comprises a lock bolt 182 which is slidably mounted in grooves 184 in the sides of receiver 16 for movement between a forward lock position wherein it engages a barrel slot 186 (see FIG. 7) in the rear end of barrel 22 and a rearward unlock position wherein it is disengaged from the barrel slot and allows the gun to be broken open (compare FIGS. 1 and 2). The bolt 182, which is generally rectangular in shape and has an oblong opening or depression 185 therein, is movable by means of a top lever 188 and a bolt actuator 190. The bolt 182 has an upper surface 192 and forwardly and downwardly sloped rear edge or surface 194 engaged with the out-of-battery pin 172 of fire control mechanism 18, and laterally spaced apart sides 196 and 198. The depression 185 is formed in upper surface 192 and communicates with two adjacent bolt actuator recesses 200 and 202 in which bolt actuator 190 is swingably mounted. The head of bolt actuator 190 lies in the smaller recess 202 and the remote end of the actuator lies in the larger clearance recess 200.

Figure 15:
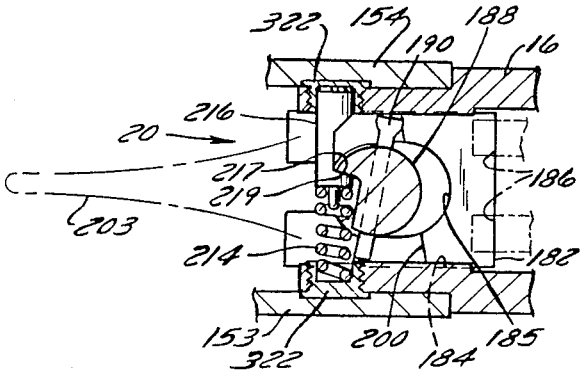
FIG. 15 is a top plan view of the components of FIG. 14 and shows them in lock position.
Figure 12:
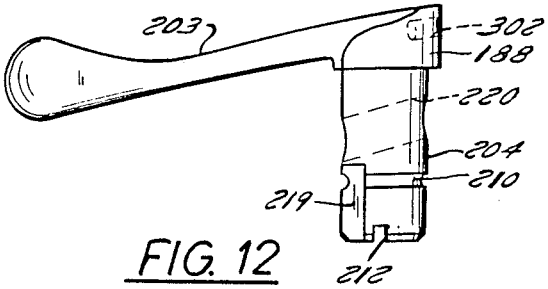
FIG. 12 is a side elevation view of the one side of the top lever.
Figure 13:
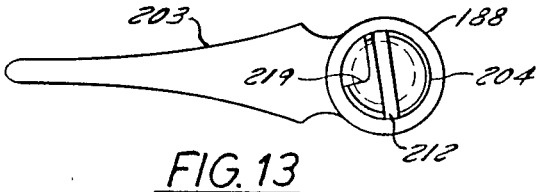
FIG. 13 is a bottom plan view of the top lever.
Figure 16:
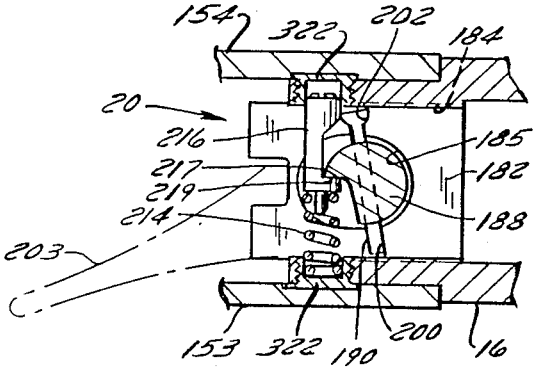
FIG. 16 is a view similar to FIG. 15 and showing the components in unlock position.
Figure 10:
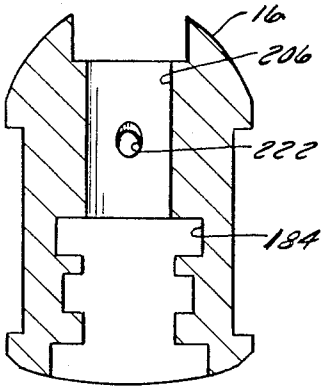
FIG. 10 is a cross-sectional view of the empty receiver taken on line 10—10 of FIG. 9.

As FIGS. 1, 2, 14, 15 and 16 show, receiver 16 supports a pivotally movable top lever 188 which engages bolt actuator 190 and operates to move bolt 182 between lock (forward) position (FIG. 15) wherein barrel 22 is locked in breech-closed position (FIG. 1) and unlock (rearward) position (FIG. 16) wherein the barrel is able to be swung downwardly to breech-open position (FIG. 2). More specifically, top lever 188 comprises a generally cylindrical vertically extending shank 204 which is rotatably mounted in a cylindrical hole 206 in receiver 16 (see FIGS. 9 and 10) and extends into depression 185 in bolt 182. The top lever further comprises a manually operable handle 203 which is rigidly fixed to the top of shank 204 and extends generally rearwardly. The handle 203 is pivotally movable horizontally through an arc of 20° between a lock position (FIG. 15) and an unlock position (FIG. 16). The shank 204 of top lever 188 is trapped in hole 206 against axial withdrawal by a bolt pin 208 (FIG. 8) which extends through bolt pin holes 209 (FIG. 9) through the lateral sides of receiver 16 and engages a groove 210 (FIG. 12) formed around the circumference of shank 204. The shank 204 has a tranverse slot 212 in its lower end in which bolt actuator 190 is engaged. The top lever 188 is biased into bolt-lock (extended) position (FIG. 15) by a top lever helical tension biasing spring 214 which operates an axially movable plunger 216 mounted on receiver 16 by entrapment between the side plates 153 and 154. The plunger 216 has a tang 217 at its inner end which engages a side edge 219 of a cut-out on the bottom end of shank 204 and biases top lever 188 toward lock position (FIG. 15). The shank 204 of top lever 188 is provided with a slanted transverse firing pin clearance hole 220 therethrough which accommodates firing pin 165. Firing pin 165 is slidably mounted in a slanted firing pin hole 222 in receiver 16 which intersects hole 206 in the receiver. Forward and rearward travel of firing pin 165 is limited by a stop pin 224 (FIG. 8) which is fixedly mounted in stop pin holes 226 (only one show in FIG. 9) in opposite sides of receiver 16. The stop pin 224 lies in a transverse groove 228 formed in the upper rear end of firing pin 165 and the width of the groove is greater than the diameter of stop pin 224 to allow for limited firing pin travel. The firing pin 165 is biased rearwardly by a helical compression firing pin return spring 230 which is disposed around the firing pin in firing pin hole 222. The return spring 230 is trapped between a shoulder 223 in firing pin hole 222 and a shoulder 234 formed on the firing pin. When biased rearwardly, the rear end of firing pin 165 extends outwardly of firing pin hole 222 into receiver chamber 150 so to be strikable by hammer 164 of the fire control assembly.

Figure 20:
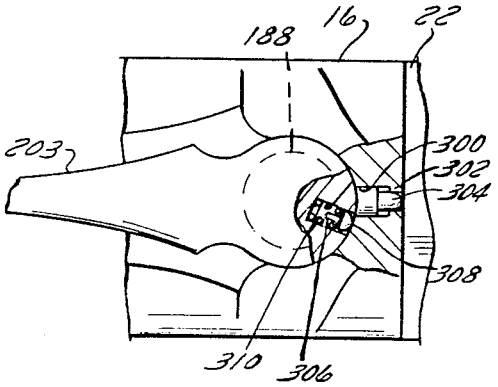
FIG. 20 is a top plan view of the top lever of FIGS. 11-16 showing it in lock position and with portions broken away to reveal a trip pin means disposed therein and in the receiver.
Figure 19:
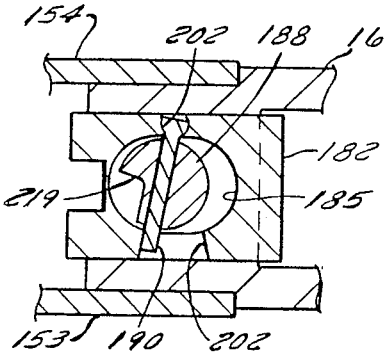
FIG. 19 is a cross-section view taken on line 19—19 of FIG. 9.
Figure 21:
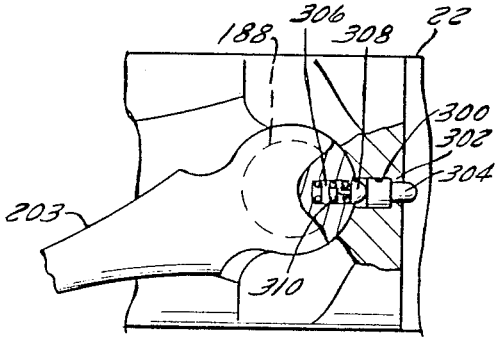
FIG. 21 is a view similar to FIG. 20 but showing the top lever swung to unlock position.

As FIGS. 8, 20 and 21 show, trip pin means are provided to prevent barrel 22 from being swung back into breech-closed position while top lever 188 is in unlock position (i.e., still swung 20° to the right). The trip pin means comprise a trip pin bore 300 in receiver 16 which has a shoulder 302 therein; a trip pin 304 in bore 300; a trip pin plunger bore 306 in top lever 188; a trip pin plunger 308 in bore 306; and a helical compression plunger spring 310 in bore 306. As FIG. 20 shows, when top lever 188 is in lock position, plunger 308 is out of alignment with trip pin 304 and the latter has been slid rearwardly by the breech end of barrel 22. However, as FIG. 21 shows, when top lever 188 is moved to unlock position (counterclockwise relative to FIG. 21 and to the right relative to the shooter), plunger 308 is aligned with and is biased against trip pin 304 causing the latter to project outwardly of trip pin bore 300 so as to prevent barrel 22 from swinging into breech-closed position.

Figure 23:
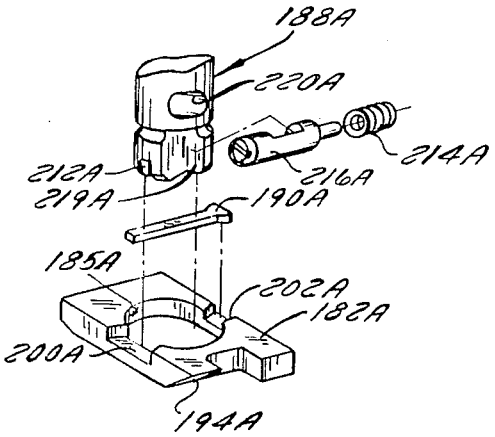
FIG. 23 is a perspective view generally similar to FIG. 14 but shows an action locking mechanism designed for a left-hand shooter instead of a right-hand shooter.
Figure 22:
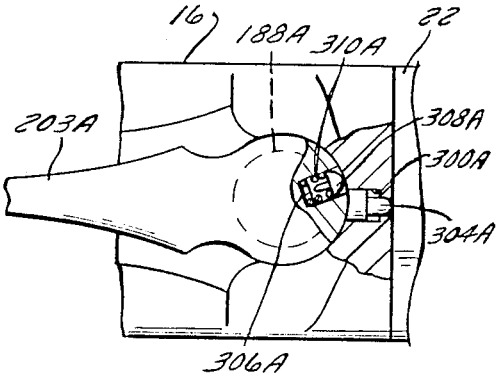
FIG. 22 is a view similar to FIG. 20 but shows a top lever designed for a left-hand shooter and wherein the trip pin means has a slightly different arrangement than in FIGS. 20 and 21.

It is to be understood that the action locking mechanism shown in FIGS. 1 through 21 is designed for a right-hand shooter. Referring to FIGS. 22 and 23, the locking mechanism shown therein is for a left-hand shooter and the top lever 188A swings leftward (i.e., clockwise relative to FIG. 22) from lock to unlock position.

The differences between the right-hand and left-hand locking mechanism depend on reversal of the orientation of certain structural features which become mirror images as regards position or location. In particular, bolt 182A in FIG. 23 is the same as bolt 182 in FIG. 14, except that its recesses 200A and 202A are reversed and bolt actuator 190A is reversed. Furthermore, top lever 188A in FIG. 2 is the same as bolt 188 in FIG. 14, except that trip pin plunger bore 306A extends at a different angle, as does firing pin clearance hole 220A. Also, the biasing spring 214A and its plunger 216A is reversed from the arrangement shown in FIGS. 15 and 16 and the lower end of top lever shank 204A is modified accordingly to reposition side edge 219A, as comparison of FIGS. 14 and 23 makes clear.

Figure 18:
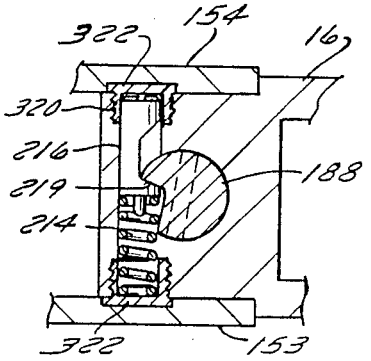
FIG. 18 is a cross-section view taken on line 18—18 of FIG. 9.

The aforedescribed reversal of parts is facilitated, as FIG. 18 shows, by designing the bore in receiver 16 in which spring 214 (or 214A) and plunger 216 (or 216A) are mounted so that the ends thereof are internally threaded as at 320 to accommodate threaded caps 322 which enable the spring and plunger to be installed during assembly in the desired orientation so as to custom fit the gun to either a right-hand or left-hand shooter.

Cocking Mechanism

Referring to FIGS. 1, 2, 8, and 9, receiver 16 is provided at its front end with a forwardly extending receiver frame 16A on which joint pin 64 is mounted. Receiver frame 16 has a longitudinal bore 240 in which an elongated cocking rod 242 of cocking mechanism 19 is slidably mounted. The rear end of cocking rod 242 is slidably engageable with the front side of a cocking link 244. The front end of cocking rod 242 is slidably engageable with a cocking insert 246 (FIGS. 1 and 2) which is rigidly secured to the rear end of fore-end iron 24 by a cocking insert mounting screw 248. As comparision of FIGS. 1 and 2 shows, when gun 10 is broken open, fore-end iron 24 pivots downwardly (clockwise in FIG. 2) about joint pin 64 relative to receiver 16 and the forwardly and downwardly sloped rear surface 250 of cocking insert 246 engages the front end of cocking rod 242 and forces the latter rearwardly into engagement with cocking link 244 which then pivots clockwise on a cocking link pin 252 to cock fire control mechanism 18 as hereinafter described in detail.

Extractor/Ejector Means

Referring to FIGS. 1, 2, 7 and 17, barrel 22 is provided at the underside of its breech end with a shell extractor/ejector 254 which is slidably mounted thereon and movable between a retracted position (FIG. 1) and either a partially extended extraction position (FIG. 2) or a fully extended ejector position (not shown), depending on the position of a telltale rod 256. Telltale rod 256 is slidably mounted in a second longitudinal bore 258 in receiver frame 16A and is normally biased rearwardly by a spring-biased plunger 260 mounted on fore-end iron 24. The extractor/ejector 254 has a groove 259 formed in its outer end face for accommodating the brass rim of the shotgun shell 12. The extractor/ejector 254 is automatically movable from extended position to retracted position (compare FIGS. 1 and 2) as the gun is closed. When gun 10 is closed, extractor/ejector 254 is retracted and the end surface of barrel 22 and the outer end face of the extractor/rejector are both flush with the front surface of receiver 16. When gun 10 is broken open, helical compression-type extractor springs 262 (FIG. 17) located in spring mounting holes 264 formed in the rear end of barrel 22 and disposed behind plungers 263 force the extractor/ejector rearwardly relative to the barrel. If a shell 12 in gun 10 has not been fired, hammer 164 is still in cocked position (see FIG. 2) and holds telltale rod 256 in a forward position wherein it forces a fore-end sear 266 into the position shown in FIG. 2. The fore-end sear 266 is mounted on fore-end iron 24 by a pin 268 and is biased clockwise by a sear spring. The sear 266 is engageable with a shoulder 270 at the rear end of extractor/ejector 254 when the gun is opened, with unfired shell 12 therein, to limit movement of extractor/ejector 254 in the extended direction to its extractor position (FIG. 2) in response to the force of extractor springs 262. On the other hand, if a shell in the gun has been fired, hammer 164 is in fired position (see FIG. 8) and allows telltale rod 256 to move rearwardly under the force of spring-loaded plunger 260 which is biased rearwardly by its compression-type biasing spring 261.

The extractor/ejector 254 has an opening 272 therethrough into which an extractor cocking insert 274 projects. The insert 274 is rigidly secured to receiver frame 16A by an attachment screw 276. As the gun is being closed, a shoulder on insert 274 engages the forward edge of opening 272 and moves extractor/ejector 254 to retracted position. When the gun is closed, insert 274 maintains the extractor/ejector in retracted position. However, when the gun is opened with a spent shell therein, the forward edge of opening 272 is clear of insert 274 and sear 266 pivots clockwise (under spring bias) out of engagement with shoulder 270 at the rear end of the extractor/ejector. This allows the extractor/ejector 254 to move to its fully extended ejector position (not shown) under the force of the spring and expel the spent shell from the gun.

Fire Control Mechanism

Returning again to consideration of fire control mechanism 18, FIGS. 1 and 2 show it cocked and FIG. 8 shows it fired. Fire control mechanism 18 is cocked by moving barrel 22 and fore-end iron 24 from the breech-closed position shown in FIG. 1 to the breech-open position shown in FIG. 2. As this occurs, cocking rod 242 is forced rearwardly by cocking insert 260 and causes cocking link 244 to pivot clockwise. As cocking link 244 so rotates, it engages the underside of hammer 164 and causes the hammer to pivot counterclockwise on hammer pin 164A. As hammer 164 so rotates, it reaches a position wherein a shoulder on the rear end thereof engages the lower front corner of sear 162 to maintain the hammer in cocked position. After this occurs, and after the gun is re-closed, cocking link 244 is able to disengage from hammer 164 and pivot counterclockwise under the force of gravity to the position shown in FIG. 1. As sear 162 pivots counterclockwise on sear pin 162A for a small distance, the rear end of sear 162 engages the upper surface of trigger 160 and causes the trigger to pivot counterclockwise on trigger pin 160A from uncocked to cocked position.

As previously explained, the position of hammer 164 controls the position of telltale rod 256 which, in turn, determines whether opening of the gun will result in partial extension of an unfired shell which can then be manually extracted, or will result in full ejection of a spent shell.

During the aforementioned counterclockwise cocking movement of hammer 164, the hammer causes rearward axial movement of mainspring plunger 168 and effects compression (charging) of the helical compression mainspring 166 mounted thereon. More specifically, the front end of mainspring plunger 168 is round and fits into a correspondingly shaped notch 169 in the rear side of hammer 164 above hammer pin 164A to form a pivotal connection. The rear end of mainspring plunger 168 is slidably mounted in a hole in a plunger support member 171 which is rotatably mounted and entrapped in a slot 171A formed in the upper edge of housing 158. The mainspring 166 is disposed on plunger 168 and is entrapped between a flat forward surface on the plunger support member 171 and a flange 171B near the front end of the mainspring plunger 168.

The out-of-battery pin 172 is slidably mounted in a hole 172A in housing 158 and a helical compression spring (not shown) within hole 172A biases pin 172 toward a forwardly extended position wherein it is in constant engagement with the sloped rear side 194 of locking bolt 182 and the rear end of the pin 172 is out of engagement with a roll-pin 160A on trigger 160. When fire control mechanism 18 is cocked and gun 10 is closed (FIG. 1), as described above, locking bolt 182 is in the lock (forward) position and out-of-battery pin 172 is extended but is axially compressible. Therefore, trigger 160 can be pulled and the gun fired. However, if gun 10 is broken open while fire control assembly 18 is cocked, locking bolt 182 is in the unlock (rearward) position and the out-of-battery pin is moved rearwardly into interfering relationship with trigger roll pin 160A thereby preventing trigger 160 from being pulled while the gun is still open.

The safety pawl 170 is manually slidable in a slot 171 in upper wall 152 of receiver 16 and is entrapped therein by a resilient leaf spring 173 which engages the underside of wall 152. The pawl 170 has a slot 290 at its lower end which pivotally engages a pin 292 on the upper end of a link 294 which is pivotally mounted on a link pin 296 on housing 158. The lower end of link 294 has a notch 294A engageable with a rearwardly extending tang 296 on trigger 160. As comparison of FIGS. 1 and 2 makes clear, when trigger 160 is in cocked position, the lower surface of link notch 294A can engage the upper surface of trigger tang 296 when safety pawl 170 is manually shifted rearwardly to "safety on" position and can also be disengaged when pawl 170 is manually shifted forwardly to "safety off" position. However, safety pawl 170 cannot be placed in "safety on" position when trigger 160 is in fired position because the surfaces are out of registry.

Assuming that gun 10 with a shotgun shell 12 therein is closed, that fire control mechanism 18 is cocked, and that safety pawl 170 is in "safety off" position, then the gun is fired as follows.

As trigger 160 is pulled and rotates clockwise, sear 162 is caused to rotate clockwise and releases hammer 164 which is then rotated clockwise as mainspring 166 expands (discharges) and causes mainspring plunger 168 to move forward. The out-of-battery pin 172 does not prevent trigger movement because lock bolt 182 is in lock (forward) position. As hammer 164 so rotates, it strikes the rear end of firing pin 165 and forces the latter forward against the bias of firing pin spring 230. The firing pin 165 strikes shell 12 and causes it to fire. When mainspring 166 is discharged, the force exerted by the firing pin return spring 230 is sufficient to pivotally move hammer 164 counterclockwise for a short distance against mainspring 166 and cocking link 244 and sear 162 do not interfere with such hammer movement. Forward movement of hammer 164 allows telltale rod 256 to be biased rearwardly and indicate that the shell has been fired.

What is claimed is:

1. In a shotgun:

a fore-end iron;

a barrel connected to said fore-end iron;

a fore-end wood handgrip rigidly secured to said fore-end iron and spaced from said barrel;

and a resilient heat-resistant low-friction member rigidly secured to said fore-end wood handgrip and tightly engaged with said barrel.

2. A shotgun according to claim 1 wherein said fore-end wood handgrip comprises a longitudinally extending groove for receiving said barrel but wherein the wall of said groove is separated from said barrel by a space; wherein said fore-end wood handgrip comprises an insert hole extending thereinto from the wall of said groove in a direction transverse to said groove; and wherein said member is disposed in said insert hole and extends outwardly therefrom across said space into engagement with said barrel.

3. A shotgun according to claim 2 wherein a portion of said member which engages said barrel has a groove which is complementary in shape to a portion of said barrel.

4. A shotgun according to claim 3 wherein said member is provided with a screw-receiving hole therethrough for receiving a screw which rigidly secures said member to said fore-end wood handgrip.

5. In a shotgun:

a fore-end iron having a barrel lug-opening therethrough, said barrel lug-opening having an edge;

a barrel having a barrel lug through said barrel lug-opening;

latch means mounted on said fore-end iron and releasably engageable with said barrel lug to releasably secure said barrel to said fore-end iron;

and adjustment means fixedly but adjustably mounted on said fore-end iron and engaged with said barrel lug to locate and maintain said barrel in a predetermined position relative to said fore-end iron.

6. A shotgun according to claim 5 wherein said adjustment means comprises an adjustment member having a portion disposed between an edge of said barrel lug opening and said barrel lug and further comprises means to adjustably move said portion of said member relative to said edge and said barrel lug to thereby locate said barrel in said predetermined position.

7. A shotgun according to claim 6 wherein said barrel lug has a sloped edge surface, wherein said portion of said adjustment member has a sloped surface engaged with said sloped edge surface of said barrel lug, and wherein said means to adjustably move said portion comprises a screw for securing said adjustment member to said fore-end iron and a shim which enables said adjustment member to be adjustably positioned vertically relative to said fore-end iron and said barrel lug.

8. A shotgun according to claim 7 wherein said sloped edge surface of said barrel lug is at the rear of said barrel lug; wherein said portion of said adjustment member is located at the rear end of said barrel lug opening; and wherein said sloped surface of said portion of said adjustment member is located at the front of said portion.

9. A shotgun according to claim 8 wherein said portion of said adjustment member is an upright portion which is disposed between the rear edge of said barrel lug opening and said rear sloped edge surface of said barrel lug and wherein said sloped surface of said portion of said adjustment member is located on the front of said upright portion.

10. A shotgun according to claim 9 wherein said rear edge of said barrel lug slopes forwardly and downwardly; wherein said front surface of said portion of said adjustment member slopes forwardly and downwardly at the same angle as the rear edge of said barrel lug; and wherein a rear surface of said portion of said adjustment member slopes forwardly and downwardly at a steeper angle than said sloped front surface of said adjustment member.

11. A shotgun comprising:

a receiver having front and rear ends;

a barrel pivotally mounted at the front end of said receiver and manually movable between breech-open and breech-closed positions;

an action locking bolt mounted on said receiver and movable into and out of engagement with said barrel between lock and unlock position, respectively;

a lever mounted on said receiver and manually movable to effect movement of said bolt between lock and unlock positions;

a trigger mounted in said receiver and manually movable from cocked to fired position;

and an out-of-battery pin mounted in said receiver in engagement with said bolt, a biasing spring for biasing said out-of-battery pin in constant engagement with said bolt; said action locking bolt being operable when in unlock position to effect compression of said biasing spring and to effect positioning of said out-of-battery pin in interfering relationship with said trigger to prevent attempted movement of said trigger from cocked position to fired position.

12. A shotgun according to claim 11 wherein said locking bolt is slidably mounted on said receiver; wherein said barrel comprises a groove for slidably receiving said action locking bolt when the latter is in lock position; wherein said lever is rotatably movable between lock and unlock positions; and wherein said out-of-battery pin has a front end in constant engagement with said bolt and a rear end disposed in interfering relationship with said trigger when said bolt is in unlock position.

13. A shotgun comprising:

a receiver having front and rear ends;

a barrel pivotally mounted at the front end of said receiver and manually movable between breech-open and breech-closed positions;

a trigger mounted in said receiver and manually movable from cocked to fired position;

an action locking bolt mounted on said receiver and movable into and out of engagement with said barrel between lock and unlock positions, respectively;

a top lever rotatably mounted on said receiver and manually movable between lock and unlock positions to effect movement of said action locking bolt between lock and unlock positions, respectively;

a firing pin mounted on said receiver and extending through ahole in said top lever and slidably movable between a retracted position and a fired position in response to movement of said trigger from cocked to fired position, said firing pin being in a fixed location relative to said barrel as said top lever rotates;

and an out-of-battery pin mounted in said receiver and engaged with said action locking bolt, a biasing spring for biasing said out-of-battery pin in constant engagement with said bolt; said action locking bolt being operable when in unlock position to effect compression of said biasing spring and to effect positioning of said out-of-battery pin in interfering relationship with said trigger to prevent attempted movement of said trigger from cocked position to fired position.

14. A shotgun comprising:

a receiver having front and rear ends;

a barrel pivotally mounted at the front end of said receiver and manually movable between breech-open and breech-closed position, said barrel having bolt-receiving groove at its breach end;

an action locking bolt slidably mounted on said receiver and movable into and out of engagement with said bolt-receiving groove in said barrel between lock and unlock positions, said bolt having transversely spaced recesses therein;

a top lever mounted on said receiver and manually movable to effect movement of said bolt from lock to unlock position, said top lever comprising a generally cylindrical shank rotatably mounted in a cylindrical bore in said receiver and having a lower end extending into said recess in said bolt;

said shank having an actuator-receiving groove in its lower end and a cam surface thereon, said shank further comprising a firing pin receiving slot extending transversely therethrough;

a bolt actuator mounted in said actuator-receiving groove of said top lever shank and extending out from opposite sides of said shank to lie in said transversely spaced recesses, said bolt actuator being responsive to rotational movement of said shank to effect said movement of said bolt;

biasing means mounted in said receiver and engaged with said cam surface on said shank to effect movement of said top lever from unlock to lock position;

a firing pin slidably mounted on said receiver and extending through said firing pin receiving slot in said shank;

a trigger mounted on said receiver and manually movable from cocked to fired position;

and an out-of-battery pin mounted in said receiver in engagement with said action locking bolt and being operable when said bolt is in unlock position to prevent said trigger from moving from cocked to fired position.

15. A shotgun comprising:

a receiver;

a stock;

means for detachably connecting said stock to the rear of said receiver;

a fore-end iron pivotally connected to the front of said receiver and having a barrel latch opening therein;

a releasable barrel latch mounted on said fore-end iron;

a fore-end wood handgrip rigidly connected to said fore-end iron and having a barrel-receiving groove therein;

a barrel having a barrel lug thereon and detachably mounted on said fore-end iron by engagement of said releasable barrel latch and said barrel lug, said barrel being disposed in the barrel-receiving groove but not in contact with said fore-end wood;

a resilient heat-resistant low-friction member fixedly mounted on said fore-end wood and in tight frictional engagement with said barrel;

an adjustably movable adjustment shoe mounted on said fore-end iron adjacent said barrel latch opening and engaged with said barrel lug to precisely position said barrel relative to said fore-end iron;

a fire control mechanism detachably mounted in said receiver and including a trigger, a sear, a hammer, and a mainspring;

an action locking bolt slidably mounted on said receiver and releasably engageable with said barrel;

a manually operably top lever rotatably mounted on said receiver for operating said action locking bolt;

a firing pin mounted on said receiver and extending through a hole in said top lever;

an out-of-battery pin being positioned between said action locking bolt and said trigger to prevent the latter from being fired when said bolt is in unlock position;

a cocking mechanism connected between said hammer and said fore-iron;

an extractor/ejector on said barrel;

and an extractor/ejector operating mechanism, including a telltale rod, mounted on said fore-end iron and operatively connected between said hammer and said extractor/ejector.

16. A shotgun according to claim 11 or 13 or including biasing means mounted on said receiver for 14 or 15 including biasing means mounted on said receiver for biasing said top lever toward lock position.

17. A shotgun according to claim 16 wherein said biasing means comprises a bore extending laterally through said receiver, a plunger in said bore engaged with said top lever, a spring mounted in said bore and engaged with said plunger, and means to close the ends of said bore to maintain said plunger and said spring entrapped therein.

18. A shotgun according to claim 17 wherein said means to close the ends of said bore comprise at least one member which is detachably connected to said receiver.

19. A shotgun according to claim 18 wherein said one member is a cap which is threadedly engaged in said bore.

* * * * *